US006655170B2

(12) United States Patent
Holz et al.

(10) Patent No.: US 6,655,170 B2
(45) Date of Patent: Dec. 2, 2003

(54) REFRIGERATOR

(75) Inventors: Walter Holz, Giengen (DE); Roland Maier, Neresheim (DE); Wolfgang Nuiding, Giengen (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 10/158,033

(22) Filed: May 30, 2002

(65) Prior Publication Data

US 2003/0000241 A1 Jan. 2, 2003

Related U.S. Application Data

(63) Continuation of application No. PCT/EP00/10556, filed on Oct. 26, 2000.

(30) Foreign Application Priority Data

Nov. 30, 1999 (DE) ..... 199 57 719

(51) Int. Cl.[7] ..... F25D 11/00

(52) U.S. Cl. ..... 62/440; 62/442; 62/447; 62/503

(58) Field of Search ..... 62/440, 441, 442, 62/447, 503, 530, 524, 525

(56) References Cited

U.S. PATENT DOCUMENTS

| | | | | |
|---|---|---|---|---|
| 2,604,761 A | | 7/1952 | Atchison | |
| 2,755,634 A | * | 7/1956 | Simmons | 62/441 |
| 3,003,333 A | | 10/1961 | Lysén | |
| 3,009,338 A | * | 11/1961 | Dobbie | 62/442 |
| 3,144,079 A | * | 8/1964 | Mack | 62/520 |
| 4,984,435 A | * | 1/1991 | Seino et al. | 62/520 |
| 5,036,680 A | * | 8/1991 | Fujiwara et al. | 62/503 |
| 5,485,732 A | | 1/1996 | Locatelli | |
| 5,765,391 A | * | 6/1998 | Lee et al. | 62/442 |

FOREIGN PATENT DOCUMENTS

DE 19535144 A1 * 3/1997 ..... F25D/11/04

* cited by examiner

*Primary Examiner*—William E. Tapolcai
*Assistant Examiner*—Mohammad M. Ali
(74) *Attorney, Agent, or Firm*—Laurence A. Greenberg; Werner H. Stemer; Ralph E. Locher

(57) ABSTRACT

A refrigerator includes a heat-insulating housing having compartments separated from one another and each having a different temperature, evaporators each cooling one of the compartments with a refrigerant, each compartment having a different refrigerating capacity, throttles each connected upstream of an evaporator, a refrigerant compressor having a suction side connected to a refrigerant collector, and at least one activator connected to the evaporators, the activator positively and separately controlling circulation of the refrigerant through the evaporators. The compressor is connected to the throttles and evaporators for circulating the refrigerant. One evaporator has a higher capacity and a refrigerant routing portion with a refrigerant reception volume. The collector collects an amount of refrigerant when the compressor is in the standstill phase. More than a majority of the reception volume of the refrigerant routing portion is filled with the refrigerant in the standstill phase of the compressor.

18 Claims, 1 Drawing Sheet

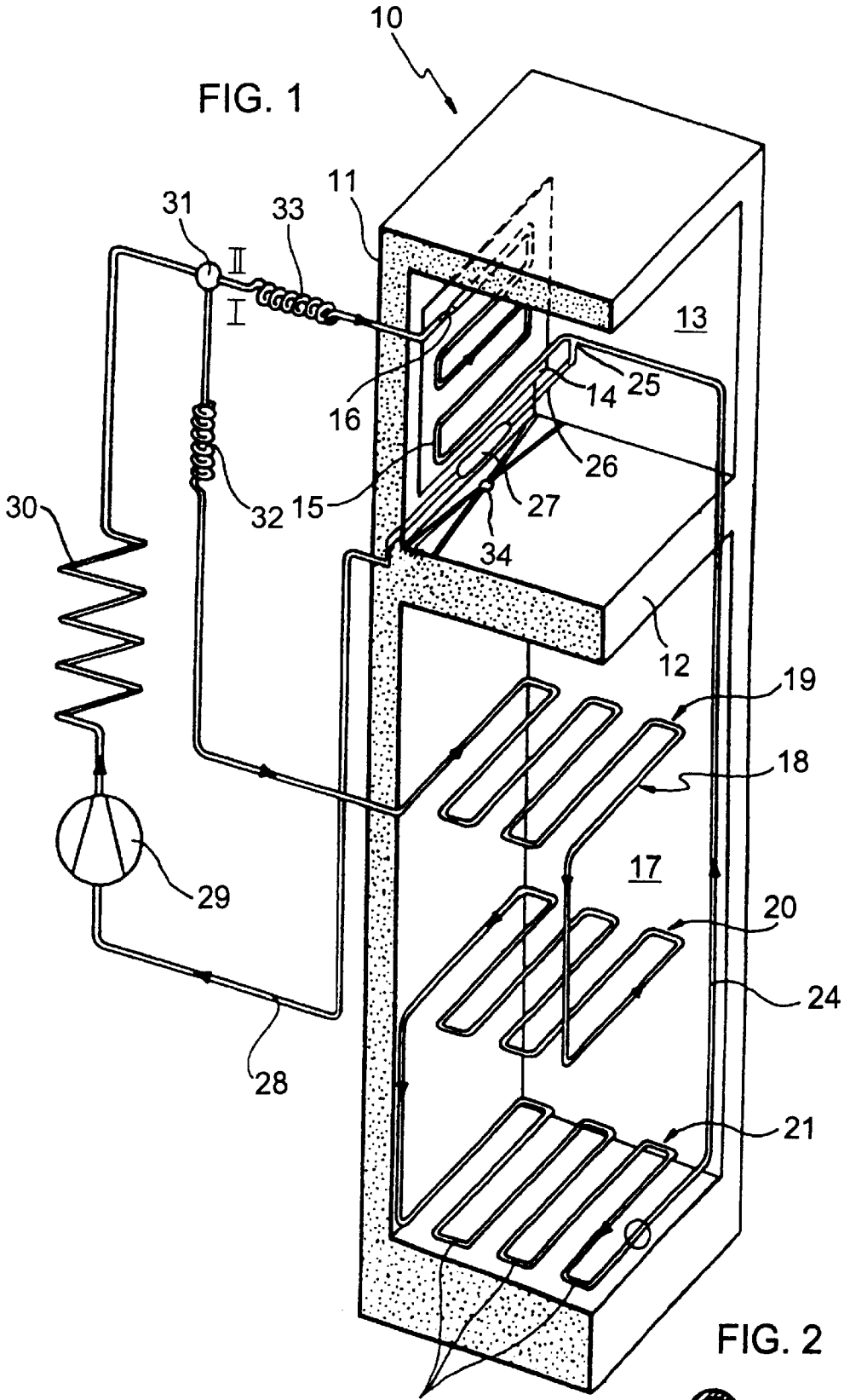
FIG. 2
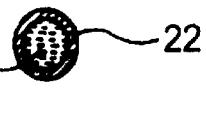

REFRIGERATOR

CROSS-REFERENCE TO RELATED APPLICATION

This application is a continuation of copending International Application No. PCT/EP00/10556, filed Oct. 26, 2000, which designated the United States.

BACKGROUND OF THE INVENTION

Field of the Invention

The invention relates to a refrigerator with a heat-insulating housing, within which are provided at least two refrigerating compartments that are separated from one another in a heat-insulating manner, have a different freezing-compartment temperature, and that are in each case cooled by an evaporator of corresponding refrigerating capacity. Each of the evaporators has a preceding throttle device on the inflow side. Each of the evaporators are acted upon by at least one activating device, in each case separately, with refrigerant that is positively circulated by a refrigerant compressor having on the suction side preceding refrigerant collector and that, when the refrigerant compressor is in the standstill phase, is collected, at least for a particular part, in a refrigerant routing portion of the evaporator having a higher refrigerating capacity.

In cooling and freezing combinations with a single compressor, existing prior art refrigerators, for example, cool their cooling and freezing compartment respectively by evaporators interlinked in a series connection, the cooling-compartment evaporator preceding the freezing-compartment evaporator in the series connection. However, such an interconnection of the evaporators does not allow separate regulation of the two refrigerating compartments. Accordingly, there has been a move, in the case of cooling and freezing combinations equipped with a single compressor, toward placing the cooling-compartment evaporator and the freezing-compartment evaporator in a parallel connection with one another. Although such a configuration allows separate temperature regulation of the compartments cooled by these evaporators, nevertheless, the result of such an interconnection is that, during the standstill time of the refrigerant compressor in the freezing-compartment evaporator, a particular displacement of refrigerant toward the freezing-compartment evaporator commences due to the temperature and pressure difference in relation to the cooling-compartment evaporator. Consequently, when there is a demand for cold in the cooling compartment, only reduced refrigerant quantity is available for cooling the cooling-compartment evaporator and, therefore, either delay times or even malfunctions may occur.

SUMMARY OF THE INVENTION

It is accordingly an object of the invention to provide a refrigerator that overcomes the hereinafore-mentioned disadvantages of the heretofore-known devices of this general type and that, by simple structural measures, is configured such that, on one hand, the disadvantages of the prior art are avoided and, on the other hand, separate temperature regulation of the refrigerating compartments becomes possible.

With the foregoing and other objects in view, there is provided, in accordance with the invention, a refrigerator including a heat-insulating housing having at least two refrigerating compartments separated from one another in a heat-insulating manner, each of the compartments having a different compartment temperature, evaporators each respectively cooling one of the compartments, and each having a given different refrigerating capacity and containing a liquid refrigerant, at least one of the evaporators having a relatively higher refrigerating capacity and a refrigerant routing portion having a refrigerant reception volume, throttles each respectively fluidically connected upstream of one of the evaporators with respect to a refrigerant flow direction, a refrigerant compressor having a suction side and a standstill phase, the compressor fluidically connected to the throttles and to the evaporators for circulating the refrigerant through the throttles and the evaporators, a refrigerant collector fluidically connected to the suction side of the refrigerant compressor, the refrigerant collector collecting an amount of the refrigerant when the compressor is in the standstill phase, more than a majority of the reception volume of the refrigerant routing portion being filled with the refrigerant in the standstill phase of the compressor, and at least one activating device fluidically connected to each of the evaporators, the activating device positively and separately controlling circulation of the refrigerant through each of the evaporators.

According to the invention, the refrigerant routing portion is constructed, in terms of its refrigerant reception volume, for at least substantially filling with liquid refrigerant in the standstill time of the compressor, in particular, for at least approximately completely filling with liquid refrigerant in the standstill time of the compressor.

To avoid disadvantages of the prior art, the invention proposes that the refrigerant routing portion of the freezing-compartment evaporator, the refrigerant routing portion serving for collecting the liquid refrigerants, be dimensioned, in terms of its reception volume, such complete filling with liquid refrigerant in the standstill time of the compressor is achieved. What is achieved thereby is that, when there is a demand for cold by the cooling compartment, the liquid refrigerant is available immediately for the refrigerating circuit of the cooling compartment.

By configuring the freezing-compartment evaporator according to the invention, when there is a demand for cold in the cooling compartment, during the start-up of the refrigerant, compressor pressure is exerted on the liquid refrigerant that has accumulated in the refrigerant routing portion during the standstill time of the refrigerant compressor. As a result, directly after the start-up of the compressor, such refrigerant is transported out of the freezing-compartment evaporator into a refrigerant collector and is available from the collector for cooling the cooling-compartment evaporator. Due to the complete filling of the evaporator portion of the freezing-compartment evaporator, the evaporator portion serving for collecting liquid refrigerant during the standstill phase of the refrigerant compressor, a pressure difference acts on the accumulated liquid refrigerant during the start-up of the compressor. As a result, the liquid refrigerant is then "entrained" out of the freezing-compartment evaporator and is, therefore, fed extremely quickly to the refrigerating circuit serving for cooling the cooling-compartment evaporator.

In accordance with another feature of the invention, the refrigerant reception volume of the refrigerant routing portion is dimensioned smaller than the quantity of liquid refrigerant that accumulates during the standstill time of the refrigerant compressor in the evaporator having a higher refrigerating capacity. Such a configuration gives cost-effective rise to extremely reliable operation for the separate regulation of the freezing compartment and the cooling compartment that, moreover, can also be switched off individually due to their separate regulatability.

The evaporator having a higher refrigerating capacity is configured particularly advantageously when, in accordance with a further feature of the invention, the evaporator of higher refrigerating capacity is configured as a freezing-compartment evaporator, of which the refrigerant routing portion lying lowest in the operating position of the refrigerator is dimensioned smaller, in terms of its refrigerant reception volume, than the refrigerant quantity accumulating there in the standstill time of the refrigerant compressor. With regard to an evaporator manufactured from a composite plate structure, complete filling of the refrigerant routing portion can be achieved, for example, by a corresponding reduction in the duct cross section.

In accordance with an added feature of the invention, the evaporator of higher refrigerating capacity is configured as an evaporator system with a plurality of evaporator levels disposed at a distance one above the other. Preferably, one of the evaporator levels is a lowest evaporator level at the lowest point. For such evaporators, both plate-like evaporator levels and what are referred to as wire-tube evaporators have proved appropriate. In the latter type of evaporators the refrigerant routing portion filled at least completely with liquid refrigerant in the standstill time of the compressor is formed by a meandering tube portion.

In accordance with an additional feature of the invention, the refrigerant collector is embedded into the heat-insulation material of the heat-insulating housing. Thereby, defrosting of the refrigerant collector when the cooling-compartment evaporator is acted upon with liquid refrigerant is prevented in a simpler reliable way.

In accordance with yet another feature of the invention, the heat-insulation material separates the at least two refrigerating compartments from one another.

In accordance with a concomitant feature of the invention, the refrigerant collector is disposed in the interception region of a condensation interception channel provided for collecting the melt water occurring at the evaporator of lower refrigerating capacity. By virtue of such a configuration of the refrigerant collector, there is no need for heat insulation to avoid the defrosting of the latter because the condensation water occurring in the event of a defrosting of the refrigerant collector is introduced directly into the already existing condensation water interception channel.

Other features that are considered as characteristic for the invention are set forth in the appended claims.

Although the invention is illustrated and described herein as embodied in a refrigerator, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 1 is a diagrammatic, partially cross-sectional perspective view of a cooling and freezing configuration according to the invention, of which the cooling compartment and the freezing compartment are cooled separately by evaporators disposed in a parallel connection and the freezing-compartment evaporator is filled, at its portion near the bottom, at least approximately completely with liquid refrigerant in the standstill stage of the refrigerant compressor; and FIG. 2 is an exploded cross-sectional view of a duct portion of the freezing-compartment evaporator filled with liquid refrigerant indicated by a solid circle near the bottom of FIG. 1.

DESCRIPTION OF THE PREFERRED EMBODIMENTS

Referring now to the figures of the drawings in detail and first, particularly to FIG. 1 thereof, there is shown a simplified diagrammatic illustration of a cooling and freezing combination 10 having a heat-insulating housing 11.

The interior of the housing 11 is subdivided by a horizontally disposed, heat-insulating, intermediate wall 12 into two portions. The higher portion is a cooling compartment 13. The intermediate wall includes a condensation water interception channel 34 for collecting melt water. For cooling the cooling compartment 13, a plate-like evaporator is provided, which has a refrigerant duct 15 having a refrigerant injection point 16 at an inflow-side end.

Provided within the heat-insulating housing 11 below the cooling compartment 13, so as to be separated from the cooling compartment 13 by the intermediate wall 12, is a freezing compartment 17 that is cooled by an evaporator 18 configured, for example, as a wire-tube evaporator and, in the present case, having three evaporator levels 19, 20, and 21 disposed at a vertical distance one above the other and generated by the corresponding shaping of a single tube conduit. Of the evaporator levels 19 to 21, the evaporator level 21 near the bottom possesses, like the other two evaporator levels 19 and 20, a refrigerant routing portion 22 that is formed from a continuously running tube conduit having a meandering shape and that, by virtue of its dimensioning, to be precise, the inside diameter and the length of the portion 22, has a refrigerant reception volume that ensures at least a complete filling of the refrigerant routing portion 22 with liquid refrigerant 23 (see, in this respect, FIG. 2) in the standstill time of a compressor, which is explained in more detail below.

The refrigerant routing portion 22, which has an installation position conducive to its complete filling, is followed by a connecting conduit 24 issuing at a branch point 25, to which the outflow-side end of the cooling-compartment evaporator 14 is also routed. The branch point 25 is connected through a connecting conduit 26 to a refrigerant collector 27, configured as a steam dome, which is embedded into the heat insulation of the intermediate bottom 12 to avoid defrosting in the cooling mode of the cooling-compartment evaporator. The refrigerant collector 27 is connected through a suction conduit 28 to a refrigerant compressor 29 connected on the delivery side to a condenser 30. An outlet side of the condenser 30 is connected, for example, to an electrically activatable 3/2-way solenoid valve 31. The 3/2-way solenoid valve 31 serves to control the refrigerant 23, positively circulated by the refrigerant compressor 29, toward the evaporators 14 and 18.

In a first control position I, the solenoid valve 31 deflects the liquid refrigerant 23 through a throttle 32 toward the freezing-compartment evaporator 18, where it is routed through the levels 19 to 21 of the evaporator 18 for cooling. When the refrigerant compressor 29 is in operation, the refrigerant 23 flows from the outflow-side end of the evaporator level 21 through the connecting conduit 24 toward the branch point 25 and, from there, to the refrigerant collector 27 and into the suction conduit 28 connected to the refrigerant compressor 29 on the suction side.

In addition to the control position I, the solenoid valve 31 possesses another control position II, in which the positively circulated liquid refrigerant 23 is fed, through a throttle 33 preceding the evaporator 14, to the evaporator 14, from which the refrigerant 23 is fed at the outflow-side of the evaporator 14, through the branch point 25 and the refrigerant collector 27, and through the suction conduit 28, again to the refrigerant compressor 29.

In the event that a demand for cold by the cooling compartment 13 is signaled after a standstill of the refrigerant compressor 29, when the refrigerant compressor 29 is restarted due to the temperature demand of the cooling compartment 13, the liquid refrigerant 23 that is accumulated in the refrigerant reception volume of the refrigerant routing portion 22 during the standstill phase of the refrigerant compressor 29 is entrained out of the refrigerant routing portion 22 and is conveyed into the steam dome that serves as a refrigerant collector 27 and where, by activation through the control position II of the solenoid valve 31, the refrigerant 23 is then available to the refrigerating circuit for cooling the cooling compartment 13. Due to the immediate activation of the liquid refrigerant 23 that, as a consequence of the principle employed, accumulates in the freezing-compartment evaporator 18 during the standstill phase of the refrigerant compressor 29 (in contrast to the prior art in which the refrigerant 23 that is accumulated in the freezing-compartment evaporator 18 during the standstill phase of the refrigerant compressor is fed only gradually to the cooling-compartment refrigerating circuit), the refrigerant 23 is transferred into the cooling-compartment 13 refrigerating circuit extremely quickly. As a result, the intended temperature in the cooling compartment 13 is reached markedly sooner, as compared with the prior art, and, therefore, the energy balance of the cooling and freezing combination is markedly improved.

We claim:

1. A refrigerator, comprising:

a heat-insulating housing having at least two refrigerating compartments separated from one another in a heat-insulating manner, each of said compartments having a different compartment temperature;

evaporators each respectively cooling one of said compartments, and each having a given different refrigerating capacity and containing a liquid refrigerant;

at least one of said evaporators having:

a relatively higher refrigerating capacity; and a refrigerant routing portion having a refrigerant reception volume;

throttles each respectively fluidically connected upstream of one of said evaporators with respect to a refrigerant flow direction;

a refrigerant compressor having a suction side, said compressor fluidically connected to said throttles and to said evaporators for circulating said refrigerant through said throttles and said evaporators;

a refrigerant collector fluidically connected to said suction side of said refrigerant compressor, said refrigerant collector collecting an amount of said refrigerant when said compressor is in a standstill phase, more than a majority of said reception volume of said refrigerant routing portion being filled with said refrigerant in the standstill phase of said compressor; and at least one activating device fluidically connected to each of said evaporators, said activating device positively and separately controlling circulation of said refrigerant through each of said evaporators.

2. The refrigerator according to claim 1, wherein said refrigerant routing portion is substantially filled with said refrigerant in said standstill phase of said compressor.

3. The refrigerator according to claim 1, wherein said refrigerant routing portion is approximately completely filled with said refrigerant in said standstill phase of said compressor.

4. The refrigerator according to claim 1, wherein said refrigerant reception volume of said refrigerant routing portion is dimensioned smaller than a quantity of refrigerant accumulating in said evaporator having the relatively higher refrigerating capacity during said standstill phase of said compressor.

5. The refrigerator according to claim 1, wherein:

said evaporator having the relatively higher refrigerating capacity is a freezing-compartment evaporator;

said freezing-compartment evaporator has a lowest point;

said refrigerant routing portion of said freezing-compartment evaporator is at said lowest point; and said refrigerant reception volume of said refrigerant routing portion is smaller than a volume of refrigerant accumulating in said refrigerant routing portion during said standstill phase of said compressor.

6. The refrigerator according to claim 1, wherein said evaporator having the relatively higher refrigerating capacity is an evaporator system having evaporator levels disposed at a distance one above another.

7. The refrigerator according to claim 5, wherein:

said evaporator having the relatively higher refrigerating capacity is an evaporator system having evaporator levels disposed at a distance one above another;

one of said evaporator levels is a lowest evaporator level; and said lowest evaporator level is at said lowest point.

8. The refrigerator according to claim 1, wherein:

said housing has heat-insulation material; and said refrigerant collector is embedded into said heat-insulation material.

9. The refrigerator according to claim 8, wherein said heat-insulation material separates said at least two refrigerating compartments from one another.

10. The refrigerator according to claim 1, wherein:

said housing has a condensation water interception channel with an interception region for collecting melt water in said interception region; and said refrigerant collector is disposed in said interception region for collecting melt water from one of said evaporators having a relatively lower refrigerating capacity.

11. A refrigerator, comprising:

a heat-insulating housing having at least two refrigerating compartments separated from one another in a heat-insulating manner, each of said compartments having a different compartment temperature;

evaporators each respectively cooling one of said compartments, and each having a given different refrigerating capacity and containing a liquid refrigerant;

at least one of said evaporators having:

a relatively higher refrigerating capacity; and a refrigerant routing portion having a refrigerant reception volume;

throttles each respectively fluidically connected upstream of one of said evaporators with respect to a refrigerant flow direction;

a refrigerant compressor having a suction side, said compressor fluidically connected to said throttles and to said evaporators for circulating said refrigerant through said throttles and said evaporators;

a refrigerant collector fluidically connected to said suction side of said refrigerant compressor, said refrigerant collector collecting an amount of said refrigerant when said compressor is in a standstill phase, said refrigerant routing portion being approximately completely filled with said refrigerant in the standstill phase of said compressor;

at least one activating device fluidically connected to each of said evaporators, said activating device positively and separately controlling circulation of said refrigerant through each of said evaporators.

12. The refrigerator according to claim 11, wherein said refrigerant reception volume of said refrigerant routing portion is dimensioned smaller than a quantity of refrigerant accumulating in said evaporator having the relatively higher refrigerating capacity during said standstill phase of said compressor.

13. The refrigerator according to claim 11, wherein:

said evaporator having the relatively higher refrigerating capacity is a freezing-compartment evaporator;

said freezing-compartment evaporator has a lowest point;

said refrigerant routing portion of said freezing-compartment evaporator is at said lowest point; and said refrigerant reception volume of said refrigerant routing portion is smaller than a volume of refrigerant accumulating in said refrigerant routing portion during said standstill phase of said compressor.

14. The refrigerator according to claim 11, wherein said evaporator having the relatively higher refrigerating capacity is an evaporator system having evaporator levels disposed at a distance one above another.

15. The refrigerator according to claim 13, wherein:

said evaporator having the relatively higher refrigerating capacity is an evaporator system having evaporator levels disposed at a distance one above another;

one of said evaporator levels is a lowest evaporator level; and said lowest evaporator level is at said lowest point.

16. The refrigerator according to claim 11, wherein:

said housing has heat-insulation material; and said refrigerant collector is embedded into said heat-insulation material.

17. The refrigerator according to claim 16, wherein said heat-insulation material separates said at least two refrigerating compartments from one another.

18. The refrigerator according to claim 11, wherein:

said housing has a condensation water interception channel with an interception region for collecting melt water in said interception region; and said refrigerant collector is disposed in said interception region for collecting melt water from one of said evaporators having a relatively lower refrigerating capacity.

* * * * *